United States Patent [19]

Selle

[11] Patent Number: 4,799,673

[45] **Date of Patent: * Jan. 24, 1989**

[54] BENCH PRESS SAFETY APPARATUS

[75] Inventor: Robert W. Selle, 6157 Pershing, Downers Grove, Ill. 60516

[73] Assignee: Robert Selle, Downers Grove, Ill.

[ * ] Notice: The portion of the term of this patent subsequent to Mar. 10, 2004 has been disclaimed.

[21] Appl. No.: 121,133

[22] Filed: Nov. 16, 1987

[51] Int. Cl.[4] ..... A63B 13/00

[52] U.S. Cl. ..... 272/123; 272/DIG. 4

[58] Field of Search ..... 272/117, 118, 123, 134, 272/144, DIG. 4

[56] References Cited

U.S. PATENT DOCUMENTS

| | | | |
|---|---|---|---|
| 3,118,668 | 1/1964 | Callahan | 272/123 |
| 3,948,513 | 4/1976 | Pfotenhauer | 272/123 X |
| 4,205,838 | 6/1980 | McIntosh | 272/123 |
| 4,249,726 | 2/1981 | Faust | 272/123 |
| 4,262,901 | 4/1981 | Faust | 272/144 X |
| 4,302,009 | 11/1981 | Johnson | 272/123 |
| 4,306,715 | 12/1981 | Sutherland | 272/117 |
| 4,368,884 | 1/1983 | Colvin | 272/123 |
| 4,411,425 | 10/1983 | Milnar | 272/123 |
| 4,615,524 | 10/1986 | Sutherland | 272/123 |
| 4,635,930 | 1/1987 | Cormier | 272/123 |
| 4,648,595 | 3/1987 | Selle | 272/123 |
| 4,650,186 | 3/1987 | McCreery et al. | 272/123 X |
| 4,757,998 | 7/1988 | Landin | 272/123 |

*Primary Examiner*—Richard J. Apley
*Assistant Examiner*—Robert W. Bahr
*Attorney, Agent, or Firm*—Mann, McWilliams, Zummer & Sweeney

[57] ABSTRACT

A bench press safety apparatus including safety supports and weight unloading shelves, which shelves are laterally adjustable to permit alignment with weight discs on a barbell supported on the safety supports. The unloading shelves support the barbell and weight discs after they have been relocated from the safety supports to the unloading shelves in order to unweight the barbell.

7 Claims, 2 Drawing Sheets

BENCH PRESS SAFETY APPARATUS

BACKGROUND OF THE INVENTION

The present invention relates to the field of bench press devices which ensure the safety of a weight lifter in the event he is unable to complete an exercise and return the barbell to its upper supported position. U.S. Pat. No. 4,648,595 to applicant herein, discloses a bench press safety apparatus having safety shelves for supporting the outer ends of a barbell and having reversible unloading members upon which the barbells may be rolled for removal of weight discs therefrom. Other arrangements of this general type are shown in the prior art U.S. Pat. Nos., 3,118,668, 3,948,513, 4,205,838, 4,262,901, 4,302,009, 4,306,715, 4,368,884 and 4,411,425. The device of the '595 patent is somewhat cumbersome in operation in that the unloading shelves can occupy only two positions, both of which are illustrated in FIG. 2 thereof. There is no provision for lateral adjustability of the unloading shelves either to accommodate different length barbells or to adjust the clearance required by individual lifters. Neither the '595 patent, nor any of the other prior art patents, discloses a bench press safety apparatus having vertically and laterally adjustable unloading shelves, landing pads mounted on the unloading shelves to prevent the weights from rolling off the unloading shelves, or stabilizer arms adapted to coact with the connector beam of the apparatus to provide additional rigidity and stability to the device.

SUMMARY OF THE INVENTION

The present invention provides a bench press safety apparatus having safety supports providing upper horizontal surfaces adapted to support the ends of a barbell in the event of a failed exercise or a dropped barbell by a weight lifter. Corresponding unloading shelves having lower horizontal surfaces are also provided, the unloading shelves mounted for selective lateral adjustment with respect to the weight discs. Both the safety supports and the unloading shelves are mounted to provide vertical adjustment. Landing pads mounted on the unloading shelves provide a nonslip surface for rolling the barbell from safety supports onto the unloading shelves and prevent the barbell from rolling off the unloading shelves while unweighting the barbell. Stabilizer arms, having stops at one end, coact with the connector beam of the apparatus to provide stability to the unloading shelves when the barbell is rolled thereupon from the safety supports.

BRIEF DESCRIPTON OF THE DRAWINGS

DETAILED DESCRIPTION OF THE INVENTION

Figure 1:
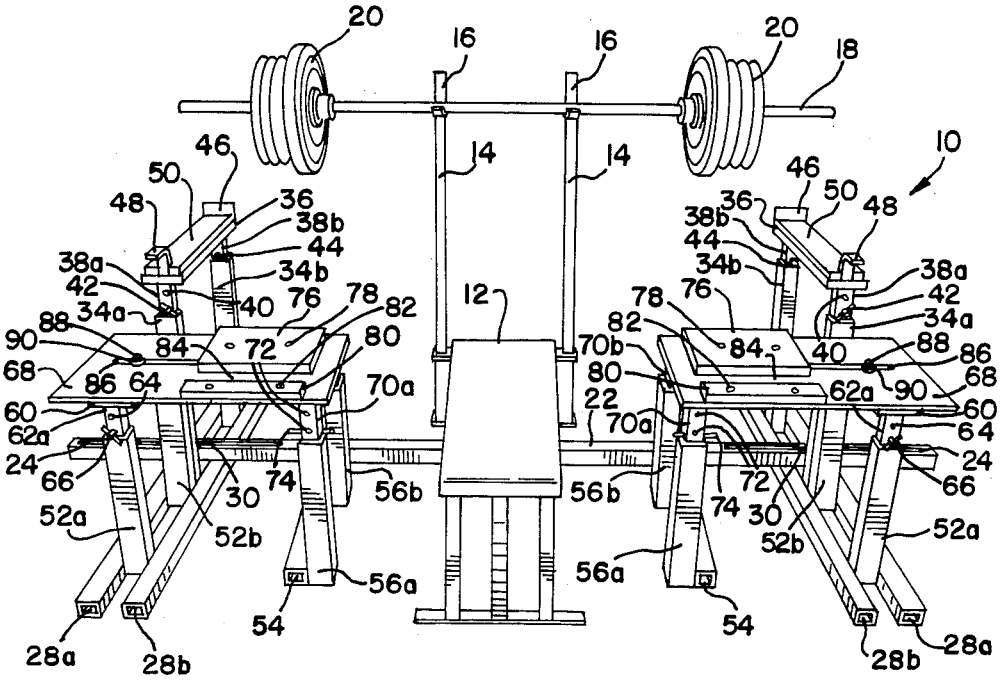
FIG. 1 shows a top perspective view of the bench press safety apparatus and a bench with a barbell supported on cradles.
Figure 4:
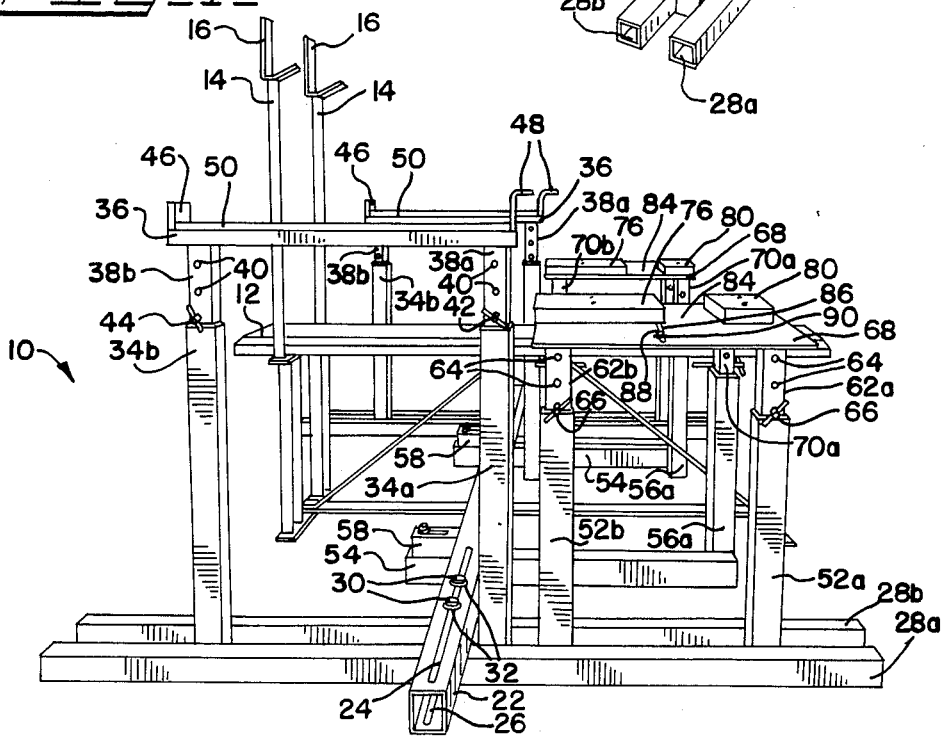
FIG. 4 shows a side perspective view of the apparatus and bench.

A bench press safety apparatus indicated generally by the numeral 10 and a standard bench 12, are shown in FIG. 1. The bench 12 includes a pair of racks 14 provided at the upper ends with cradles 16 which support a barbell 18 upon which weight discs 20 are placed. A connector beam 22 is provided, the beam 22 having a laterally-extending slot 24 formed in the upper surface of each end thereof and a corresponding laterally-extending slot 26, as seen in FIG. 4, formed in the lower surface of each end thereof. The connector beam 22 extends the entire width of the apparatus and connects and is adapted to be mounted upon two substantially identical pairs of base rails **28*a* and 28*b*, each base rail 28*a*, 28*b* provided with an aperture formed in its upper surface near the center thereof. The connector beam 22 is mounted atop the base rails 28*a*, 28*b* in perpendicular relationship thereto and in perpendicular relationship to the bench 12, such that one pair of base rails is mounted at one end of the connector beam 22, the other pair of base rails is mounted at the opposite end of the connector beam 22, and the bench 12 is located centrally between the two pairs of base rails 28*a*, 28*b* so that it lies in parallel relationship to them. The slots 24 and 26 in the connector beam 22 are aligned with the apertures in the base rails 28*a*, 28*b*. Bolts 30 are inserted through washers 32 and are then received through the slots 24, 26 and into the apertures in the base rails 28*a*, 28*b*, thereby slidably securing the base rails 28*a*, 28*b* to permit lateral adjustment of the base rails 28*a*, 28*b* in relation to the bench 12**.

A safety support leg assembly 34 consisting of a pair of legs **34*a*, 34*b* is provided. The legs 34*a*, 34*b* are rigidly secured in an upright position, as by welding, between the base rails 28*a* and 28*b*. As seen in FIG. 4, leg 34*a* is mounted to the right of the connector beam 22 and leg 34*b*** is mounted left of the beam.

A safety support 36 is provided on each side of the bench 12 to support the ends of the barbell 18 in the event of a failed exercise or a dropped barbell by a weight lifter. The substantially rectangular safety support 36 is rigidly mounted upon a pair of legs 38, the legs **38*a* and 38*b* being spaced from one another the same distance as support legs 34*a*, 34*b* and the legs 38*a* and 38*b* telescopingly being received in the support legs 34*a* and 34*b*, respectively. Legs 38*a* and 38*b* are provided with a plurality of apertures 40. The apertures in leg 38*a* are spaced at the same distance as the apertures in leg 38*b*. When the legs 38 are telescopingly received in the legs 34, a pin 42 may be inserted through corresponding apertures in leg 38*a* and a pin 44 inserted through opposing corresponding apertures in leg 38*b*. The pins 42 and 44 extend from either side of the legs 38*a* and 38*b*, respectively, and contact the tops of support legs 34*a* and 34*b*, respectively, thereby securing the legs 38 in the support legs 34 at the desired height position. Relocating the pins 42 and 44** permits vertical adjustability of the safety supports to permit the weight lifter to get a full range of motion while exercising and to accommodate different sized weight lifters.

A stop 46 is rigidly secured to the left end of the safety support 36, as viewed in FIG. 4, to prevent the barbell 18 from rolling off the left end of the safety support 36. A safety pin 48 is removably secured to the right end of the safety support 36 to prevent the barbell 18 from rolling off the right end of the safety support 36 until desired. A rubber cushion pad 50 is inserted in the tray configuration of the safety support 36 to further prevent slippage of the barbell 18 thereon and to provide shock absorption and reduce the noise created by the barbell 18 contacting the safety support 36.

An unloading shelf bridge member leg assembly 52 consisting of legs 52*a* and 52*b*, is provided. The legs 52*a*, 52*b* are rigidly secured in an upright position, as by welding, between the base rails 28*a* and 28*b*.

A stabilizer arm 54, adapted to coact with the unloading shelf bridge member leg assembly 52 and the connector beam 22, is provided. The stabilizer arm 54 has an unloading shelf outer leg 56*a* rigidly secured to the inner forward face thereof and another substantially identical unloading shelf outer leg 56*b* rigidly secured to the inner face at a distance rearwardly of the leg 56*a*, such that the distance between stabilizer legs 56*a* and 56*b* is equal to the distance between legs 52*a* and 52*b* of the unloading shelf bridge member leg assembly 52. As best seen in FIG. 4, a stop 58 is mounted on the stabilizer arm 54 at the rear thereof. The stabilizer arm 54 is positioned beneath the connector beam 22 in perpendicular relation thereto and in parallel relation to the side rails 28 such that the front face of the stop 58 contacts the rear face of the connector beam 22. The significance of the coaction between the stabilizer arm 54 and the connector beam 22 will be explained below.

An unloading shelf bridge member 60, which is a substantially rectangular plate having an aperture provided in the center thereof, is rigidly secured atop legs 62*a* and 62*b*. Legs 62*a* and 62*b* are provided on all four sides with a plurality of corresponding apertures 64, as seen in FIG. 4, and pins 66 to be inserted therethrough. The legs 62*a* and 62*b* are adapted to be received telescopingly into the unloading shelf legs 52*a* and 52*b*, respectively, such that vertical adjustment of the unloading shelf bridge member 60 may be accomplished in the same manner as the vertical adjustment of the safety support 34.

Figure 2:
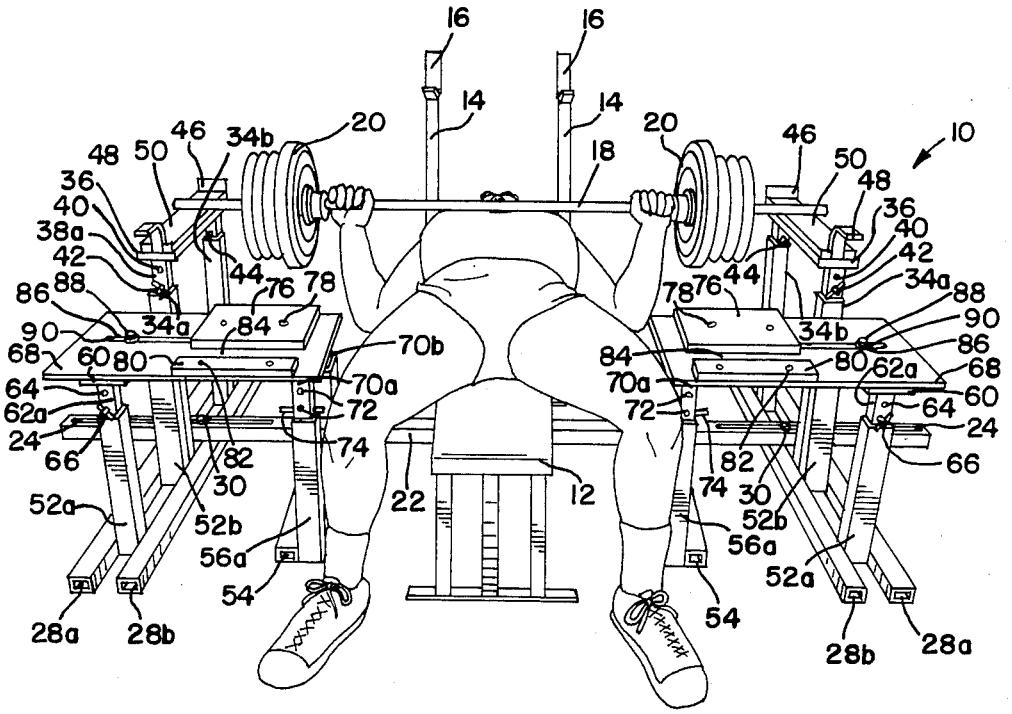
FIG. 2 shows a top perspective view of the apparatus with the ends of the barbell supported on the safety supports and a weight lifter reclining on the bench.

An unloading shelf 68 comprised of a substantially rectangular plate is rigidly secured atop a pair of legs 70*a* and 70*b* on each side of the bench 12, as best shown in FIGS. 1 and 2. Leg 70*a* is telescopingly received in stabilizer leg 56*a*. Leg 70*b* is telescopingly received in stabilizer leg 56*b*. The legs 70*a* and 70*b* each are provided with a plurality of corresponding apertures 72 on all four sides and pins 74 to be inserted therethrough, so that vertical adjustment of the unloading shelf 68 may be accomplished the same way as for the safety support 34 and the unloading shelf bridge member 60.

Figure 3:
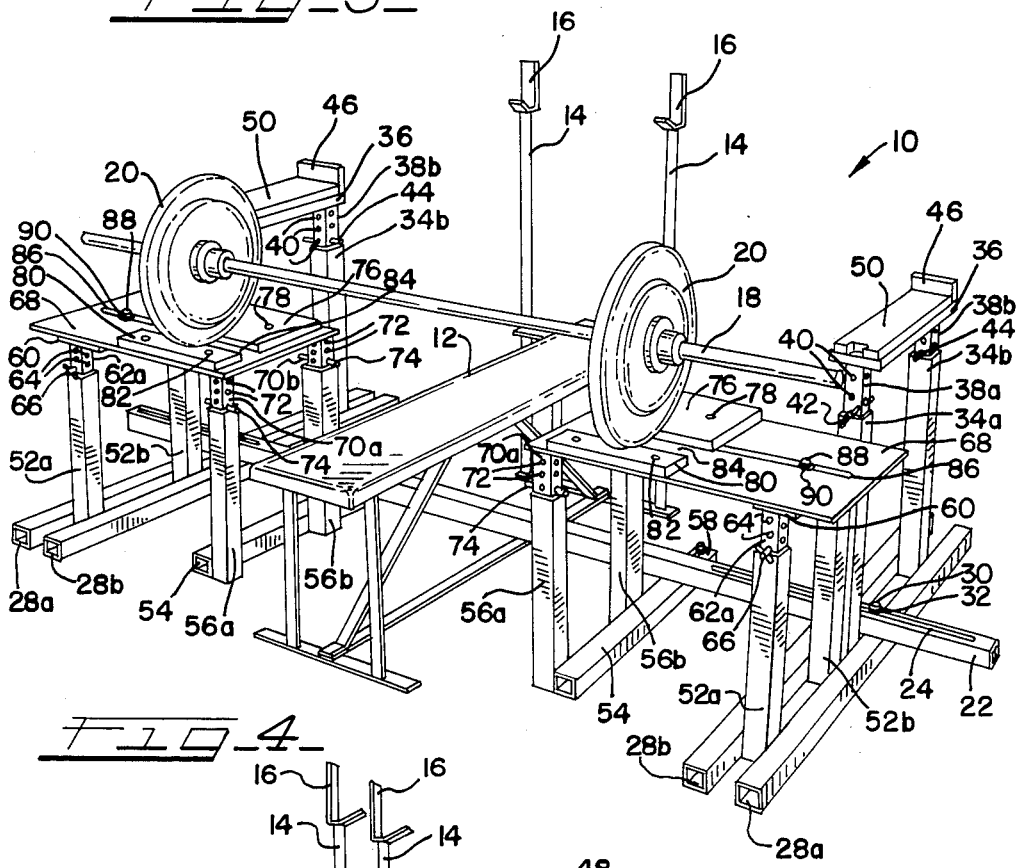
FIG. 3 shows a top perspective view of the apparatus with the barbell and weight discs positioned on the unloading shelves.

A first landing pad 76, formed of rubber or any other material suitable to provide cushioning and a nonslip surface, is firmly secured by means of bolts 78 to the upper surface of each unloading shelf 68. A second landing pad 80, smaller in width than the first landing pad 76, is attached by means of bolts 82 to the upper surface of the unloading shelf 68 directly forward of the first landing pad 76 such that a well or groove 84 is formed between the first and second landing pads 76 and 80, respectively. As seen in FIG. 3, when the barbell 18, loaded with weight discs 20, is rolled from the safety supports 36 and onto the unloading shelf 68, the weight discs 20 settle in the well 84 formed between landing pads 76 and 80, thereby preventing the barbell 18 and weight discs 20 from rolling off the unloading shelf 68. The rubber construction of the landing pads 76 and 80 also prevents slippage of the weights 20. Because the stop 58 on the stabilizer arm 54 contacts the connector beam 22, forward inertia of the stabilizer arm 54 is prevented from the force of the barbell 18 and weight discs 20 being rolled from the safety supports 36 onto the unloading shelves 68, thereby adding rigidity and stability to the unloading shelves 68.

A laterally-extending slot 86 is provided in the center of each unloading shelf 68 and extends from the center of the unloading shelf 68 to the outer side which is supported by the unloading shelf bridge member 60. A bolt 88, inserted through a washer 90, is inserted through the slot 86 and into the aperture in the unloading shelf bridge member 60, thereby securing the unloading shelf 68 to the unloading shelf bridge member 60. The legs 62*a* and 62b of the unloading shelf bridge member 60 are telescopingly inserted into the unloading shelf outer legs 52*a* and 52*b*, respectively. Then legs 70*a* and 70*b*, of the unloading shelf 68, are telescopingly inserted into the unloading shelf outer legs 56*a* and 56*b*, respectively. The unloading shelves 68 are laterally adjustable in relation to the weight discs 20 on the barbell 18 as the barbell 18 is supported on the safety supports 36, so that the landing pads 76, 80 may be aligned with the discs 20 depending on the number of discs 20 on the barbell 18, where the discs 20 are positioned on the barbell 18, and the length of the barbell used. In addition, the unloading shelves 68 may need to be adjusted to provide more or less clearance for each weight lifter while he is exercising so that he can get a full range of motion. Lateral adjustment of the unloading shelves 68 may be achieved by loosening the bolt 88 and exerting lateral force on the unloading shelf 68 in the direction of desired relocation.

Bench press exercises are done to build up the pectoral muscles of the chest. The exercise consists of lying on one's back on the weight bench, gripping and removing the weight-laden barbell 18 from the cradles 16 of the bench rack 14, then lowering the barbell 18 to one's chest, raising the barbell 18 upwardly again until one's elbows lock, and then repeating the exercise by lowering and raising the barbell a set number of times. Often times, in an effort to eke out one more repetition, a weight lifter will overestimate his ability and not be able to complete the exercise and return the barbell 18 to the cradles 16 of the bench rack 14. This is a dangerous predicament for the weight lifter because if the weighted barbell is allowed to drop on the weight lifter, serious harm or even death may occur.

As shown in FIG. 2, the weight lifter has failed to complete the exercise and the barbell has dropped downwardly, but before landing on the weight lifter, the ends of the barbell 18, have engaged the safety supports 36 and spared the lifter serious harm. The lifter may then slide out from beneath the barbell 18. The lifter then laterally adjusts the unloading shelves 68 so that the landing pads 76, 80 are aligned with the weight discs 20 on the barbell 18. After removing the safety pins 48 from the safety supports 36, the lifter may roll the barbell 18 off the safety supports 36 and onto the unloading shelves 68. He may then remove one or more weight discs 20, return the barbell 18 to the safety supports 36 then slide underneath the barbell 18, press the barbell 18 upwardly onto the cradles 16, add weight if desired, and continue his exercising.

Thus it has been shown that the present invention provides a bench press safety apparatus having vertically and laterally adjustable unloading shelves and vertically adjustable safety supports.

Various features of the invention have been particularly shown and described in connection with the illustrated embodiment of the invention, however, it must be understood that these particular arrangements merely illustrate and that the invention is to be given its fullest interpretation with the terms of the appended claims.

What is claimed is:

1. A bench press safety apparatus for weight lifters using a barbell with weight discs thereon, said apparatus comprising a connector beam, a left- and a right-hand safety support, each of said safety supports joined to said connector beam to secure said safety supports at a fixed distance apart and lend stability and rigidity thereto, each of said safety supports providing an upper horizontal surface to support the ends of said barbell in the event of a failed exercise or dropping of the barbell by a weight lifter using said apparatus, thus precluding injury to said weight lifter, a left- and a right-hand unloading shelf, each shelf providing a lower horizontal surface positioned at a lower level than said upper horizontal surface of said corresponding safety support and spaced laterally inwardly of said upper horizontal support for receiving and supporting said weight discs, means mounting each of said unloading shelves for selective lateral adjustment with respect to said weight discs whereby said weight lifter, having been protected from injury during a failed exercise or dropped barbell by said barbell ends falling on said safety supports, may then relocate said barbell and weight discs from a first position in which said safety supports support said barbell ends, to a second position in which said unloading shelves receive and support said weight discs to facilitate unweighting of the barbell and resumption of the exercise routine.

2. A bench press safety apparatus as in claim 1 in which said means for mounting each of said unloading shelves for lateral adjustment includes a fixed support surface, a plate mounted on said support surface provided with a laterally-extending slot and fastening means extending from said fixed support surface through said slot to serve as a guide for lateral adjustability of said unloading shelf top accommodate lateral adjustability of said unloading shelves in relation to said weight discs.

3. A bench press safety apparatus as in claim 1 including at least one landing pad, with a slot defined therein, secured to the top surface of each of said unloading shelves to fixedly position said barbell and weight discs on said unloading shelves to prevent said barbell from rolling off said unloading shelves when unweighting said barbell.

4. A bench press safety apparatus as in claim 1 in which said means mounting said unloading shelves include means to provide for vertical adjustment of said shelves as well as lateral adjustment.

5. A bench press safety apparatus as in claim 1 including a stabilizer arm secured between each unloading shelf and said connector beam, said stabilizer arm provided with a stop at one end thereof, adapted to coact with said connector beam, thereby adding stability to said unloading shelves when said barbell is rolled thereupon from said safety supports.

6. A bench press safety apparatus as in claim 1 in which each of the safety supports includes a removable safety pin at one end thereof to prevent said barbell from rolling off said safety support until such time as the weight lifter desires to move said barbell to said unloading shelves.

7. A bench press safety apparatus as in claim 1 including mounting means for said safety supports to provide for vertical adjustment thereof.

* * * * *